US009659514B2

(12) United States Patent
Jang

(10) Patent No.: US 9,659,514 B2
(45) Date of Patent: May 23, 2017

(54) DISPLAY DEVICE AND METHOD WITH GHOST CANCELLATION ACCORDING TO IMAGE BLOCKS

(71) Applicant: SAMSUNG ELECTRONICS CO., LTD., Suwon-si (KR)

(72) Inventor: Ki Soo Jang, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 284 days.

(21) Appl. No.: 14/513,691

(22) Filed: Oct. 14, 2014

(65) Prior Publication Data

US 2015/0161936 A1 Jun. 11, 2015

(30) Foreign Application Priority Data

Dec. 9, 2013 (KR) ..... 10-2013-0152496

(51) Int. Cl.
*G09G 3/20* (2006.01)

(52) U.S. Cl.
CPC ..... *G09G 3/20* (2013.01); *G09G 2320/0257* (2013.01); *G09G 2320/046* (2013.01); *G09G 2320/106* (2013.01); *G09G 2330/027* (2013.01)

(58) Field of Classification Search
CPC ..... G09G 2320/046; G09G 2320/0257; H04N 5/211
See application file for complete search history.

(56) References Cited

U.S. PATENT DOCUMENTS 5,623,318 A * 4/1997 Lee ..... H04N 5/211 348/614
7,466,340 B1 * 12/2008 Herz ..... G09G 3/20 348/173
2006/0202945 A1 * 9/2006 Feng ..... G09G 3/342 345/102
2007/0164932 A1 * 7/2007 Moon ..... G09G 3/288 345/63
2009/0096778 A1 * 4/2009 Su ..... G09G 3/006 345/214
2010/0097413 A1 * 4/2010 Matsumoto ..... G09G 3/2944 345/691
2010/0245602 A1 * 9/2010 Webster ..... H04N 5/211 348/208.4
2011/0032248 A1 * 2/2011 Atkins ..... G09G 3/20 345/214
2011/0227961 A1 * 9/2011 Kikuta ..... G09G 3/3225 345/690
2011/0273482 A1 * 11/2011 Massart ..... G09G 3/20 345/690

(Continued)

*Primary Examiner* — Gene W Lee
(74) *Attorney, Agent, or Firm* — Sughrue Mion, PLLC

(57) ABSTRACT

Disclosed herein is a display device for determining whether or not ghost exists in a unit of a block to perform ghost cancellation, and a control method of the display device. According to an embodiment, the display device includes: a screen configured to display an image; a calculator configured to partition the screen into a plurality of blocks and determine whether or not ghost exists in at least one block of the blocks; and a controller configured to cancel ghost existing in the at least one block in response to the calculator determining that the ghost exists in the at least one block of the blocks.

19 Claims, 14 Drawing Sheets

(56) References Cited

U.S. PATENT DOCUMENTS

| | | | | |
|---|---|---|---|---|
| 2012/0169789 | A1* | 7/2012 | Origuchi | G09G 3/294 345/690 |
| 2012/0194570 | A1* | 8/2012 | Muto | G09G 3/344 345/690 |
| 2013/0002733 | A1* | 1/2013 | Origuchi | G09G 3/003 345/690 |
| 2013/0169663 | A1* | 7/2013 | Seong | G09G 5/00 345/589 |
| 2014/0092144 | A1* | 4/2014 | Kim | G09G 3/3233 345/690 |
| 2014/0375704 | A1* | 12/2014 | Bi | G09G 3/3275 345/694 |
| 2015/0103108 | A1* | 4/2015 | Seong | G09G 3/22 345/694 |
| 2015/0154939 | A1* | 6/2015 | Zhan | G06T 7/00 345/589 |

* cited by examiner

DISPLAY DEVICE AND METHOD WITH GHOST CANCELLATION ACCORDING TO IMAGE BLOCKS

CROSS-REFERENCE TO RELATED APPLICATION

This application claims priority from Korean Patent Application No. 2013-0152496, filed on Dec. 9, 2013 in the Korean Intellectual Property Office, the disclosure of which is incorporated herein by reference.

BACKGROUND

1. Field

Exemplary embodiments of the present disclosure relate to a display device and a control method thereof.

2. Description of the Related Art

A display device of the related art can display three-dimensional images.

A flat panel display device of the related art is free from spatial constraints since it has a low-weight and a slim body compared to a Cathode Ray Tube (CRT). Further, the flat panel display device of the related art can display a large-screen image with a high image quality.

However, if the flat display device of the related art displays the same image for a long time, phosphors or luminous bodies of the corresponding area may deteriorate or be denatured. When another image is displayed after such deterioration or denaturalization occurs, the screen is damaged, resulting in a ghost. The ghost may lower the quality of an image that is displayed on the screen.

SUMMARY

Therefore, an aspect of the exemplary embodiments may provide a display device for determining whether or not ghost exists in a unit of a block to perform ghost cancellation, and a control method of the display device.

Additional aspects of the disclosure will be set forth in part in the description which follows and, in part, will be obvious from the description, or may be learned by practice of the disclosure.

In accordance with an aspect of an exemplary embodiment, a display device includes: a screen configured to display an image; a calculator configured to partition the screen into a plurality of blocks and determine whether or not ghost exists in at least one block of the blocks; and a controller configured to cancel existing ghost in the at least one block in response to the calculator determining that the ghost exists in the at least one block of the blocks.

The calculator may be further configured to determine whether a sub image displayed in the at least one block is a still image and determine whether or not the ghost exists in the at least one block based on each of the determined sub image displayed in the at least one block.

The calculator may be further configured to calculate a motion vector of the at least one block to determine whether or not the ghost exists in the at least one block.

The calculator may be configured to determine a shape of the ghost existing in the at least one block in response to the calculator determining that the ghost exists in the at least one block.

The calculator may be configured to determine a level of the ghost in response to the calculator determining that the ghost exists in the at least one block, wherein the level of the ghost is determined according to a time period in which a still image is displayed in the at least one block.

The controller may be further configured to display a ghost cancellation image in the at least one block to cancel the ghost.

The controller may be further configured to display a ghost cancellation image which corresponds to the shape of the ghost in the at least one block such that the ghost is cancelled.

The controller may be further configured to display a ghost cancellation image in the at least one block for a time period which corresponds to the level of the ghost, such that the ghost is cancelled.

In response to the calculator determining that no ghost exists in any of the blocks, the controller may be further configured to power off the display device according to a predetermined input.

In accordance with another aspect of an exemplary embodiment, a control method of a display device which includes a screen configured to display an image, the control method including: partitioning the image into a plurality of blocks; determining whether or not ghost exists in at least one block of the blocks; and cancelling existing ghost in the at least one block in response to determining that the ghost exists in the at least one block of the blocks.

The determining whether or not ghost exists in the at least one block may include determining whether a sub image displayed in the at least one block of the blocks is a still image.

The determining whether or not ghost exists in the at least one block may include calculating a motion vector of the at least one block of the blocks.

The determining whether or not ghost exists in the at least one block may further include determining a shape of the ghost existing in the at least one block in response to determining that the ghost exists in the at least one block.

The determining whether or not ghost exists in the at least one block may further include determining a level of the ghost in response to determining that the ghost exists in the at least one block, wherein the level of the ghost is determined according to a time period in which a still image is displayed in the at least one block.

The cancelling the existing ghost in the at least one block may include displaying a ghost cancellation image in the at least one block to cancel the ghost.

The cancelling the ghost existing in the at least one block may include displaying a ghost cancellation image which corresponds to the shape of the ghost in the at least one block such that the ghost is cancelled.

The cancelling the ghost existing in the at least one block may include displaying a ghost cancellation image in the at least one block for a time period which corresponds to the level of the ghost such that the ghost is cancelled.

The control method may further include turning off power according to a predetermined input in response to determining that no ghost exists in any of the blocks.

In accordance with yet another aspect of an exemplary embodiment, a method of determining whether ghost exists in an image, the method including: partitioning an image into a plurality of blocks such that each block of the block comprises at least one pixel; calculating a motion vector which comprises a direction and a magnitude of each block of the blocks over a predetermined time period; and determining ghost exists in each block of the blocks in response to the motion vector including no direction and no magnitude over the predetermined time period.

According to an aspect of the display device and the control method thereof, when it is determined that ghost exists, the display device may automatically perform ghost cancellation before power-off. By automatically performing ghost cancellation without receiving a user input for performing ghost cancellation, it is possible to prevent quality deterioration of an image that is displayed.

According to another aspect of the display device and the control method thereof, since it is determined whether ghost exists in a unit of a block to perform appropriate ghost cancellation for each block, ghost may be efficiently cancelled.

BRIEF DESCRIPTION OF THE DRAWINGS

These and/or other aspects of the disclosure will become apparent and more readily appreciated from the following description of the exemplary embodiments, taken in conjunction with the accompanying drawings of which.

DETAILED DESCRIPTION OF EXEMPLARY EMBODIMENTS

Figure 1:
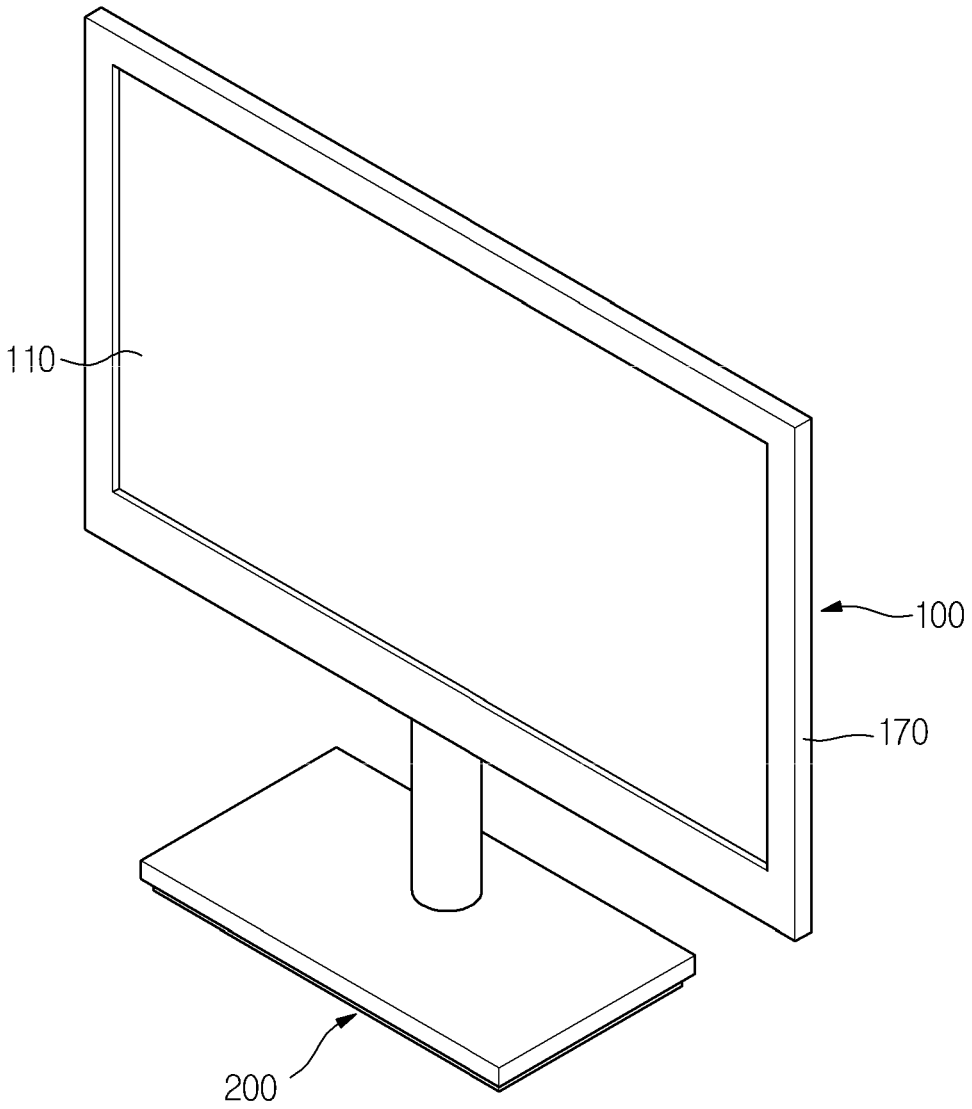
FIG. 1 illustrates an external appearance of a display device according to an exemplary embodiment of the present disclosure.

Reference will now be made in detail to the exemplary embodiments of the present disclosure, examples of which are illustrated in the accompanying drawings, wherein like reference numerals refer to like elements throughout.

A display device and a control method thereof according to exemplary embodiments of the present disclosure will be described with reference to the appended drawings, below.

FIG. 1 illustrates an external appearance of a display device according to an exemplary embodiment of the present disclosure.

Referring to FIG. 1, a display device 100 is used to display images. The display device 100 may be a display of a television, a monitor, or a mobile communication terminal.

As illustrated in FIG. 1, the display device 100 may further include a screen 110 to display an image, and a housing 170 surrounding the screen 110. Also, the display device 100 may further include a stand 200 to support the housing 100.

The screen 110 may display an image based on received output signals. The image may be a still image which is not affected by the passage of time, or a moving image which changes over time.

The screen 110 may include a display panel. The display panel may be a Liquid Crystal Display (LCD) panel, an Electro-Luminescence Display (ELD) panel, a Field Emission Display (FED) panel, a Plasma Display Panel (PDP), a Thin Film Transistor-Liquid Crystal Display (TFT-LCD) panel, or an Organic Light Emitting Diode (OLED) panel.

When the screen 110 including such a display panel displays a still image for a predetermined time or more, pixels may deteriorate and a ghost may be generated. More specifically, if a still image is displayed on the screen 110 for a long time, the life of pixels displaying the still image on the screen becomes shorter than that of the other pixels. As a result, the ghost may remain on the screen 110 when the still image changes to another image. Since the ghost may deteriorate the quality of the image, ghost cancellation needs to be performed.

The display device 100 may include a ghost cancellation function for cancelling the ghost. In an exemplary embodiment of ghost cancellation, a method may periodically shift a still image on the screen 110 in up, down, left, and right directions. In another exemplary embodiment of ghost cancellation, a method may display a specific pattern for cancelling ghost on the screen 110 to protect specific pixels.

The ghost cancellation function of the display device 100 may also be performed when a user observes ghost, and applies an input for performing the ghost cancellation function. That is, since detection of ghost may depend on a user observation, the user may experience inconvenience with the observed ghost, and ghost cancellation may be ineffective. In order to mitigate this issue, a display device may be capable of determining whether or not ghost exists without receiving a user input to perform ghost cancellation, and a control method of the display device.

Figure 2:
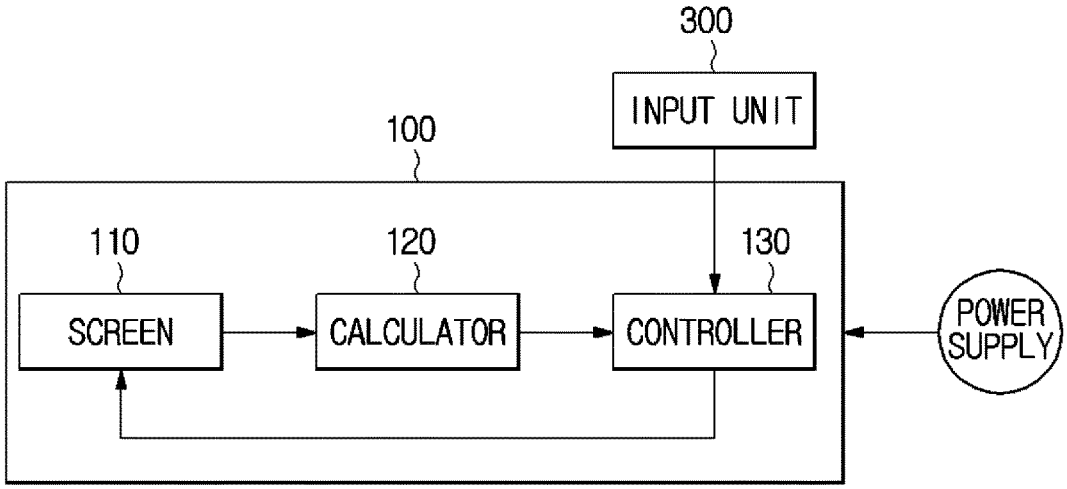
FIG. 2 is a control block diagram of a display device according to an exemplary embodiment of the present disclosure.

FIG. 2 is a control block diagram of a display device according to an exemplary embodiment of the present disclosure.

Referring to FIG. 2, a display device 100 may include a screen 110 to display an image, a calculator 120 to partition the screen 110 into a plurality of blocks and to determine whether or not ghost exists in each block, and a controller 130 to cancel, if the calculator 120 determines that ghost exists in at least one of the plurality of blocks, the ghost existing in the at least one block. The display device 100 may further include an input unit 300 to receive a power-on/off input from a user. The controller may comprise at least one processor for performing its respective functions.

The screen 110 may display an image according to a power-on input received from the input unit 300. More specifically, if the input unit 300 receives a power-on input from a user, the controller 130 may power on the display device 100. Thus, power is supplied to the screen 110 so that the screen 110 displays an image based on received output signals.

The screen 110 may be composed of a plurality of pixels. The pixels are smallest units of brightness points forming the screen 110.

Figure 3A:
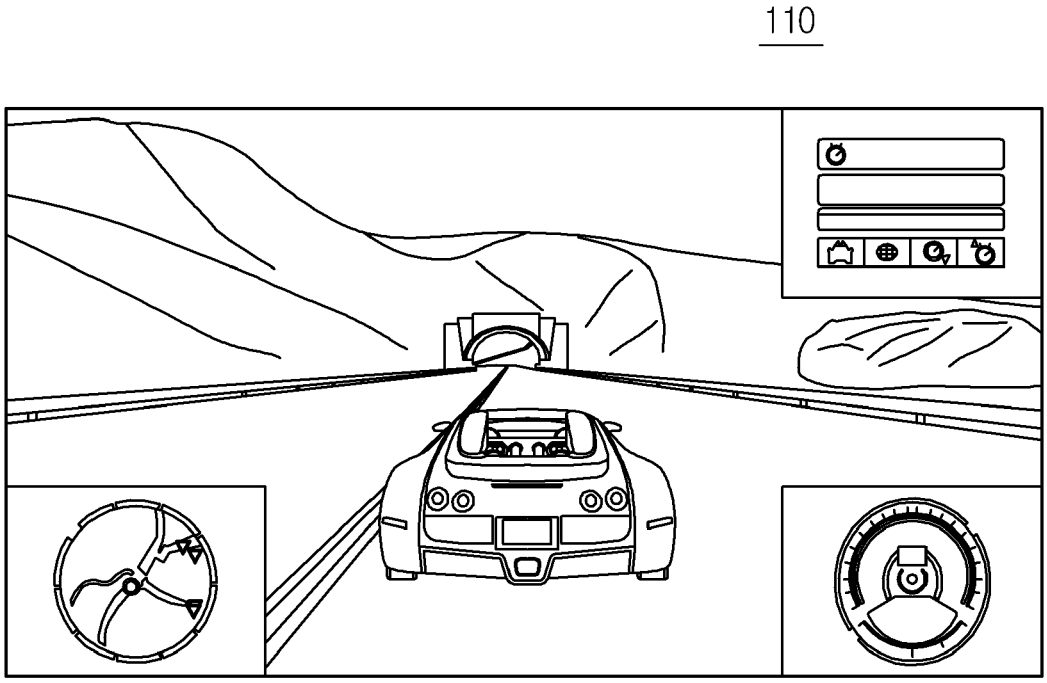
FIG. 3A shows an example of an image displayed on a screen.
Figure 3B:
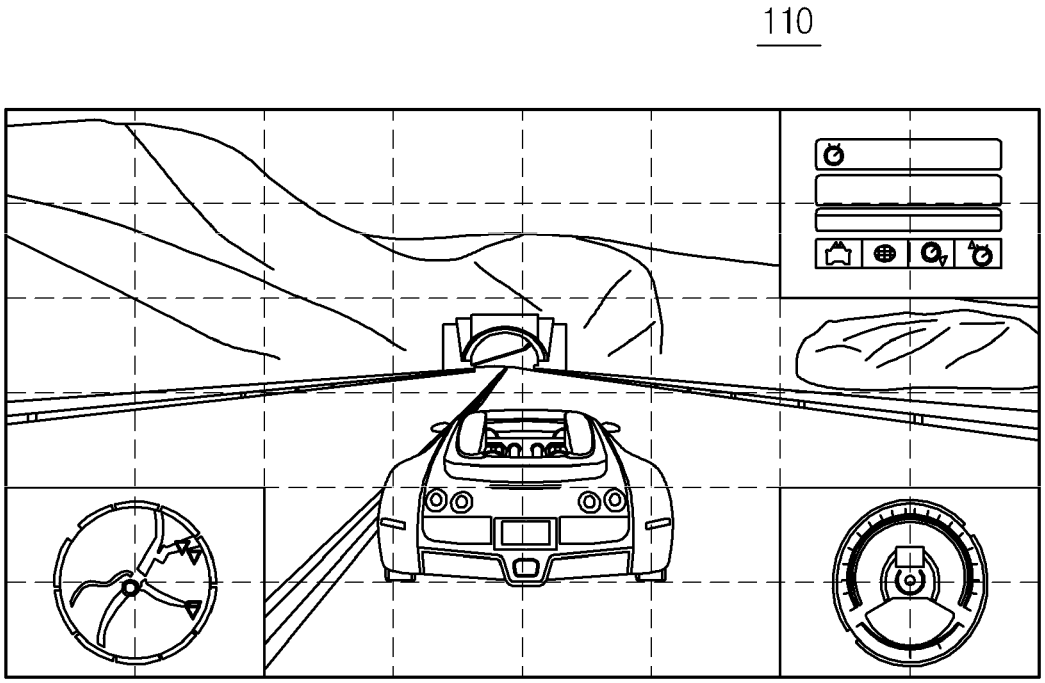
FIG. 3B shows an example of a screen partitioned into a plurality of blocks.

The calculator 120 may partition the screen 110 into a plurality of blocks, and determine whether or not ghost exists in each block FIG. 3A shows an example of an image displayed on a screen, and FIG. 3B shows an example of a screen partitioned into a plurality of blocks. In FIG. 3B, dotted lines are imaginary lines for describing a screen partitioned into a plurality of blocks.

As shown in FIG. 3A, when an image is displayed on a screen 110, the calculator 120 (see FIG. 2) may partition the screen 110 into a plurality of blocks, as shown in FIG. 3B. Each block may be a group of one or more pixels, and the blocks may include the same number of pixels. However, the blocks may also include different numbers of pixels. The screen 110 may be partitioned into a predetermined number of blocks.

By partitioning the screen 110 into a plurality of blocks, it is possible to apply different ghost cancellation methods in a unit of a block. Thus, the ghost cancellation efficiency is improved.

In order to perform ghost cancellation in a unit of a block, the calculator 120 may determine whether or not ghost exists in each block. In order to determine whether or not ghost exists in each block, the calculator 120 may determine whether an image displayed in each block is a still image. Since ghost can be generated due to a deterioration of pixels when a still image is displayed on the screen 110 for a long time, the calculator 120 may determine that ghost exists if the image displayed in each block is a still image.

Whether an image displayed in each block is a still image may be determined by calculating a motion vector of each block including one or more pixels on the screen 110.

Hereinafter, a method of calculating a motion vector will be described with reference to FIGS. 4A to 4C and FIG. 5.

Figure 4A:
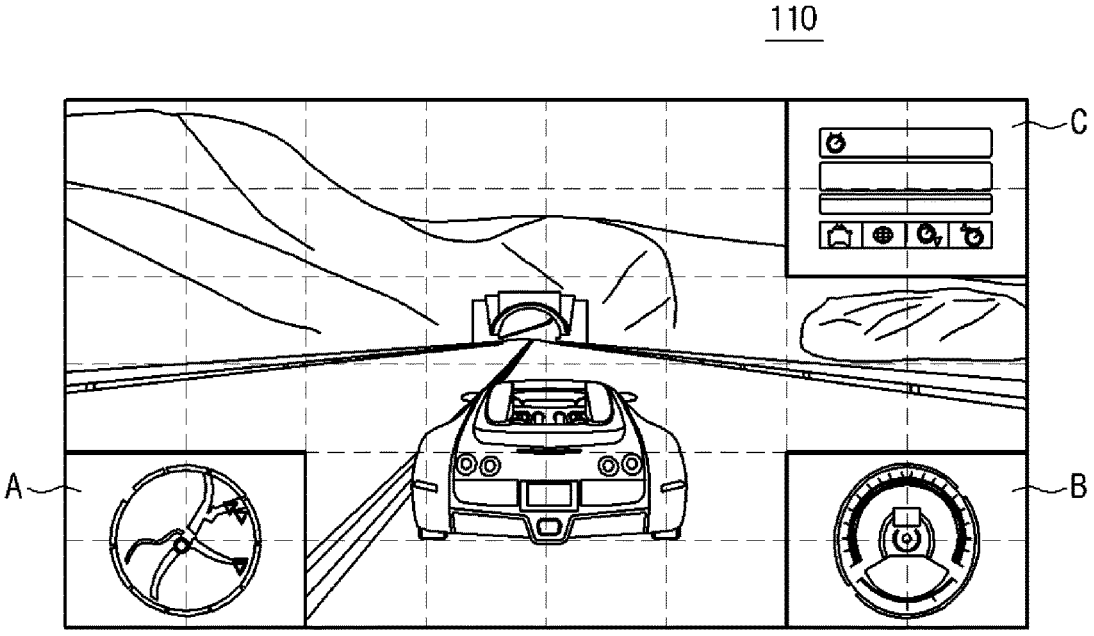
FIGS. 4A, 4B, and 4C show examples of images that are displayed on a screen over time.
Figure 4B:
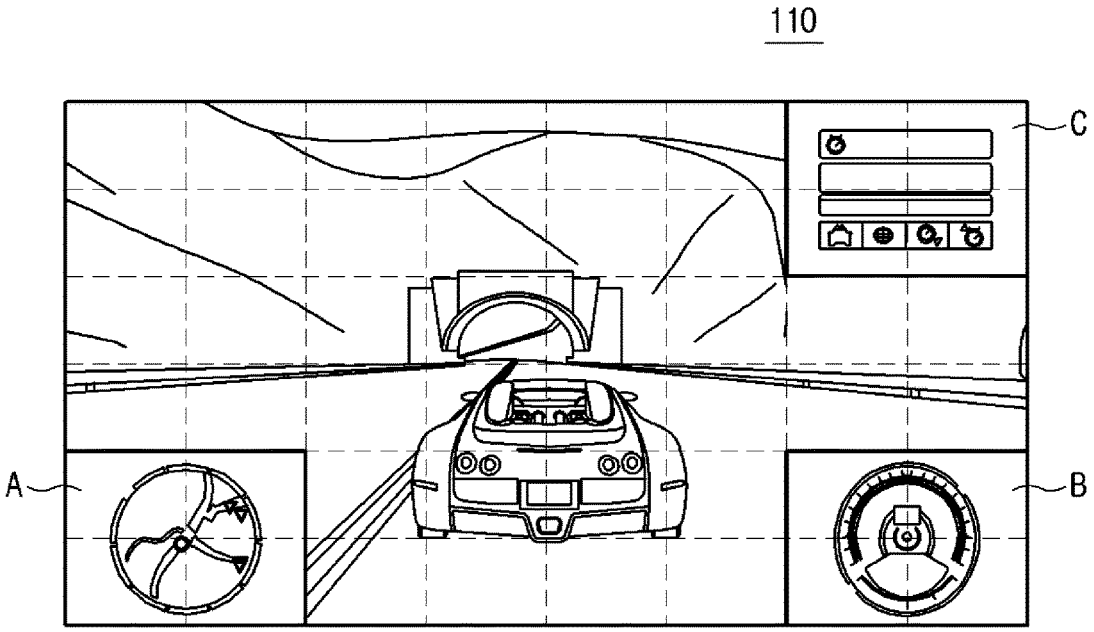
Figure 4C:
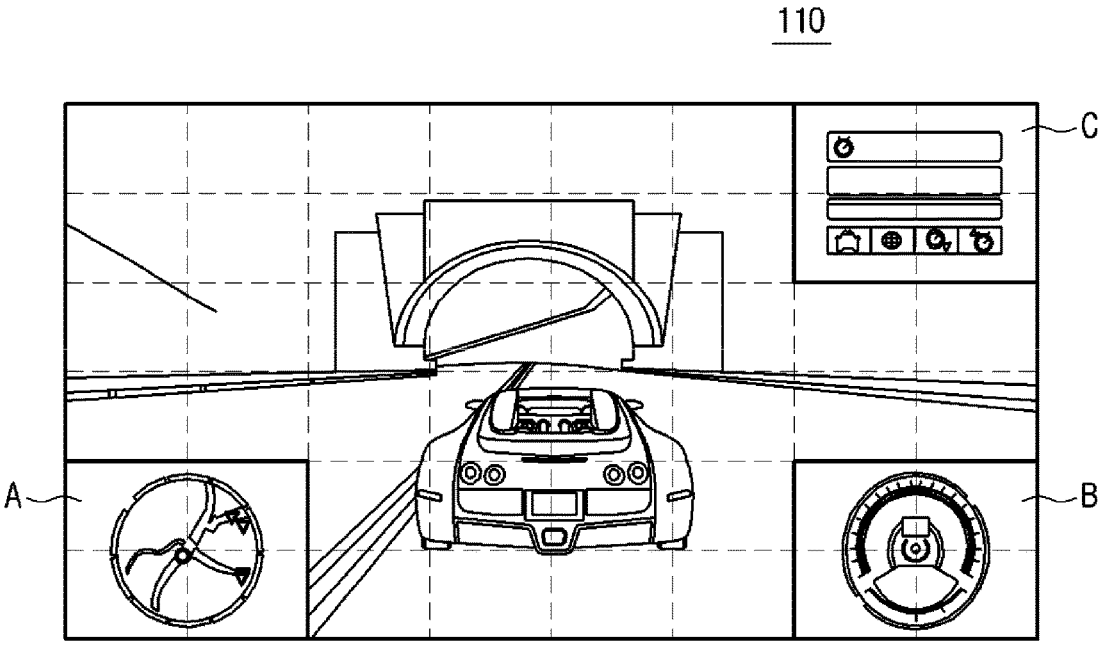

FIGS. 4A, 4B, and 4C show examples of images that are displayed on a screen over time, wherein dotted lines are imaginary lines for describing a screen partitioned into a plurality of blocks. FIG. 4A shows a first image that is displayed on a screen 110, and FIGS. 4B and 4C show images that are displayed on the screen 110 at regular time intervals.

The screen 110 may display a still image or a moving image. The images shown in FIGS. 4A, 4B, and 4C are moving images that change over time. However, the entire moving image does not change over time. That is, a part of the moving image may change over time while the other part does not change over time. Accordingly, whether an image displayed on the screen 110 is a still image may be determined in a unit of a block.

Referring to FIGS. 4A, 4B, and 4C, some parts of the images do not change over time. The parts that do not change over time can be considered still images. For example, A, B, and C are areas of the images that can be considered still images which do not change by the passage of time. In fact, A, B, and C areas do not change between the images shown in FIGS. 4A, 4B, and 4C. If a certain area is determined to be a still image, it may be determined that ghost exists in the area, such that the area becomes a target subject to ghost cancellation.

Determining whether an image is a still image may be part of the pre-processing for ghost cancellation. Accordingly, it is important to accurately determine whether an image is a still image. Whether an image is a still image may be mathematically determined by calculating a motion vector.

A motion vector is a vector representing a direction and a magnitude of displacement of an object from an image of a viewpoint to an image of another viewpoint. For example, in a moving image, a motion vector may represent an apparent motion of an object between two sequential image frames.

Figure 5:
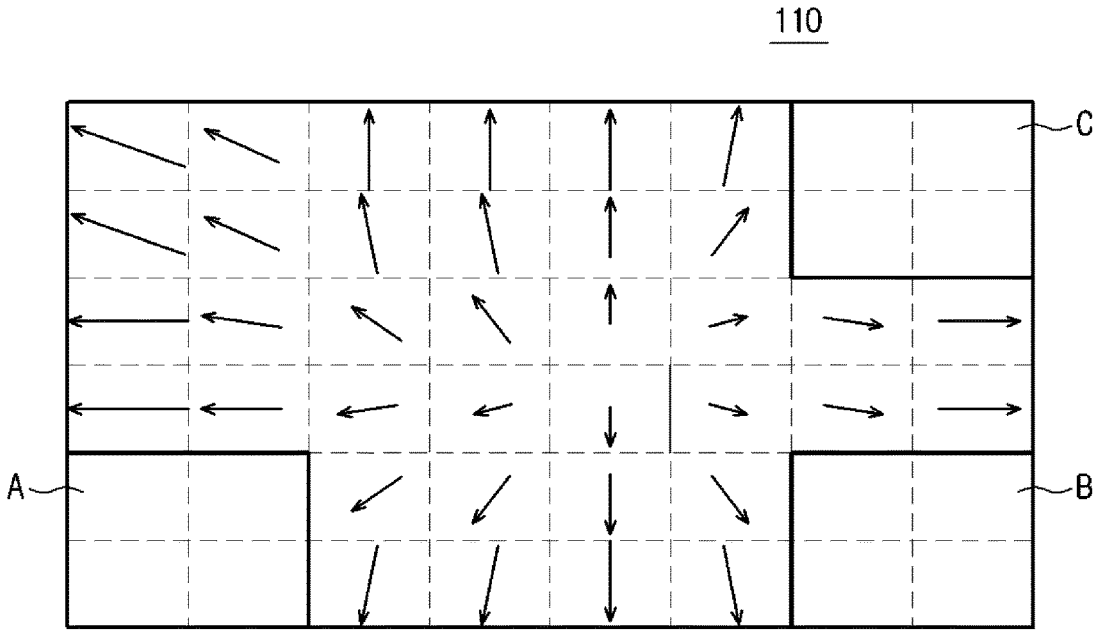
FIG. 5 shows examples of motion vectors corresponding to individual blocks.

FIG. 5 shows examples of motion vectors corresponding to individual blocks. An arrow in each block represents a motion vector of the block. FIG. 5 shows motion vectors acquired from moving images respectively displayed at a time $t_1$ and at a time $t_2$ after a predetermined time period from the time $t_1$ is elapsed on the screen 110.

A motion vector is a vector having a magnitude and a direction. That is, movement directions and movement distances of blocks of the image displayed at the time $t_1$ during a time period from the time $t_1$ to the time $t_2$ may be represented as motion vectors.

Referring to FIG. 5, since the motion vectors are obtained from the images displayed at the times $t_1$ and $t_2$, most blocks have motion vector values. In order to represent an object moving toward a vanishing point located at the center of the screen 110, most blocks may have motion vectors of directions pointing away from the vanishing point.

However, since blocks corresponding to the A, B, and C areas display the same images at the times $t_1$ and $t_2$, the motion vectors of the A, B, and C areas become zero. The motion vectors of the A, B, and C areas have neither magnitude nor direction. In this case, the blocks corresponding to the A, B, and C areas may be determined to display still images at the times $t_1$ and $t_2$.

If the calculator 120 determines that the ghost exists, the calculator 120 may accumulate the motion vectors of the corresponding blocks. That is, the calculator 120 may repeatedly perform operations of obtaining motion vectors from two sequential image frames at regular time intervals, and accumulate the obtained motion vectors in the corresponding blocks.

If a motion vector is zero, it may be determined that a still image is displayed in the corresponding block. Accordingly, by accumulating motion vectors, a time period for which a still image is displayed may be measured. The longer time period for which a still image is displayed, the greater degree of deterioration of pixels displaying the still image. Accordingly, a level of ghost may be determined based on a time period for which a still image is displayed. The level of ghost may be digitized according to a time period for which the still image is displayed.

Also, if the calculator 120 determines that ghost exists in a block, the calculator 120 may determine a shape of the ghost. In order to cancel the ghost, a ghost cancellation image, which will be described later, may be displayed on a screen. By displaying a ghost cancellation image corresponding to a shape of ghost on a screen, the ghost may be more efficiently cancelled.

Figure 6:
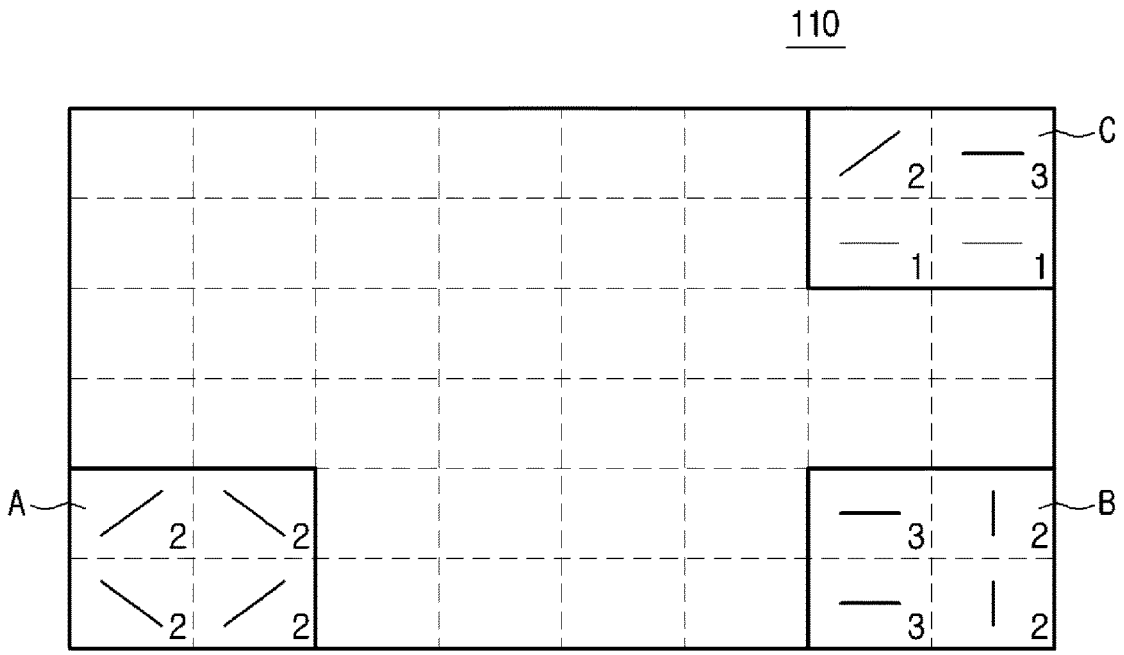
FIG. 6 shows examples of levels and shapes of ghost corresponding to individual blocks.

FIG. 6 shows examples of levels and shapes of ghost corresponding to individual blocks. Patterns in the blocks show the shapes of ghost, and numerals in the blocks show the levels of ghost. The levels of ghost are assumed to range from 1 to 3, wherein 1 corresponds to a level of ghost when a still image is displayed for a shortest time period, and 3 corresponds to a level of ghost when a still image is displayed for a longest time period.

As shown in FIGS. 4A to 4C and FIG. 5, the A, B, and C areas are areas in which still images are displayed. Accordingly, it can be determined that ghost exist in the A, B, and C areas.

If it is determined that ghost exists in the A, B, and C areas, the controller 130 (see FIG. 2) may determine levels and shapes of the ghost. Referring to FIG. 6, a level and a shape of ghost may be determined for each of the blocks belonging to the A, B, and C areas.

For example, in the lower and left block of the A area, a diagonal line shape of ghost has been generated, and a level of the ghost is 2. A level and a shape of ghost are determined for each block in which the ghost exists, and ghost cancellation may be performed based on the level and shape of the ghost.

Referring again to FIG. 2, if the calculator 120 determines that ghost exists in at least one of a plurality of blocks, the controller 130 may cancel the ghost existing in the at least one block. The controller 130 may cancel the ghost existing in at least one block when receiving a power-off command through the input unit 300, or when receiving a predetermined command.

Figure 7:
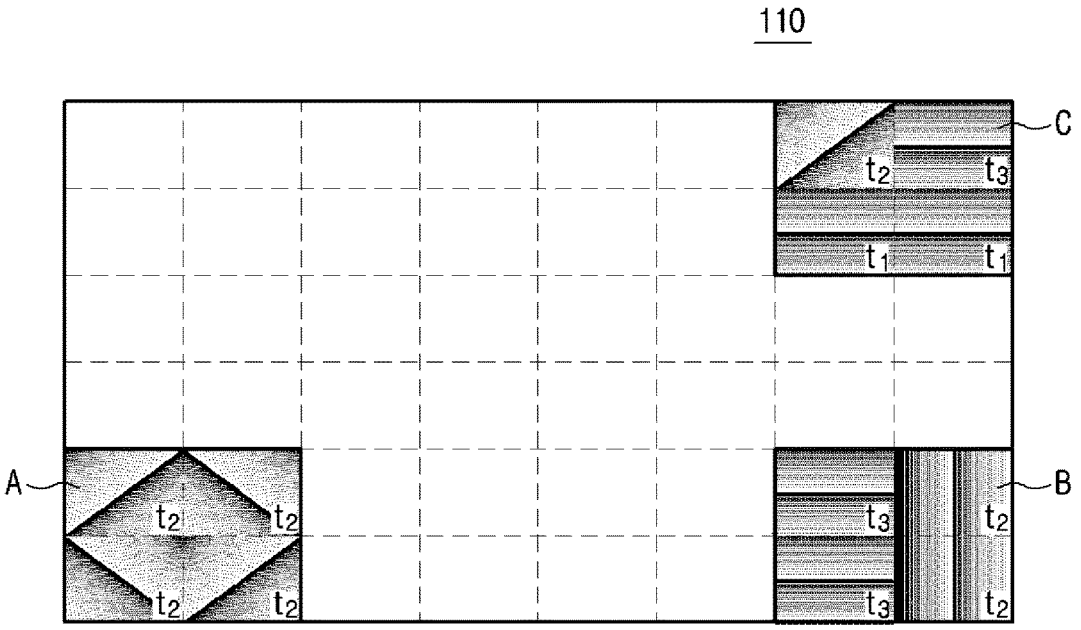
FIG. 7 is a view for describing a method of performing ghost cancellation using ghost cancellation images corresponding to individual blocks, according to an exemplary embodiment of the present disclosure.

FIG. 7 is a view for describing a method of performing ghost cancellation using ghost cancellation images corresponding to individual blocks, according to an exemplary embodiment of the present disclosure.

The controller 130 (see FIG. 2) may display a predetermined ghost cancellation image in a block in which ghost exists, in order to cancel the ghost. By displaying a ghost cancellation image only in a block in which ghost exists, ghost cancellation is prevented from being unnecessarily performed on areas in which no ghost exists. Also, the controller 130 may perform appropriate ghost cancellation according to a level and a shape of ghost existing in each block, thereby increasing the efficiency of ghost cancellation.

For example, if the calculator 120 (see FIG. 2) determines levels and shapes of ghost as shown in FIG. 6, the controller 130 may perform ghost cancellation based on the levels and shapes of ghost. More specifically, the controller 130 may cancel ghost in a block by displaying a ghost cancellation image corresponding to the shape of the ghost in the block for a time period corresponding to the level of the ghost.

Referring to FIG. 6, in the B area, a horizontal line shape of ghost and a vertical line shape of ghost have been generated, a level of the horizontal line shape of ghost is 3, and a level of the vertical line shape of ghost is 2.

In this case, ghost cancellation images as shown in FIG. 7 may be displayed. In order to cancel the horizontal line shape of ghost, a ghost cancellation image in which a row of pixels aligned in a horizontal direction has the same pixel value may be displayed. Also, in order to cancel the vertical line shape of ghost, a ghost cancellation image in which a column of pixels aligned in a vertical direction has the same pixel value may be displayed.

The ghost cancellation images may be displayed for different time periods depending on the levels of the corresponding ghost. As an exemplary embodiment of a display time period of a ghost cancellation image, if a level of ghost is 1, a time period $t_1$ is a display time period of the ghost. Further, if a level of ghost is 2, a time period $t_2$ is a display time period of the ghost. Finally, if a level of ghost is 3, a time period $t_3$ is a display time period of the ghost. Since the higher level of ghosts correspond to the higher degree of deterioration of the corresponding pixels, the lengths of the display time periods $t_1$, $t_2$, and $t_3$ are in an order of $t_1<t_2<t_3$.

In the B area of FIG. 7, ghost cancellation images corresponding to the shapes of ghost as shown in FIG. 6 may be respectively displayed for display time periods corresponding to the levels of the ghost. Since the blocks of the B area have different shapes and different levels of ghost, different ghost cancellation images may be displayed in the respective blocks for different display time periods.

By performing optimized ghost cancellation for each block, the efficiency of ghost cancellation may increase.

Figure 8:
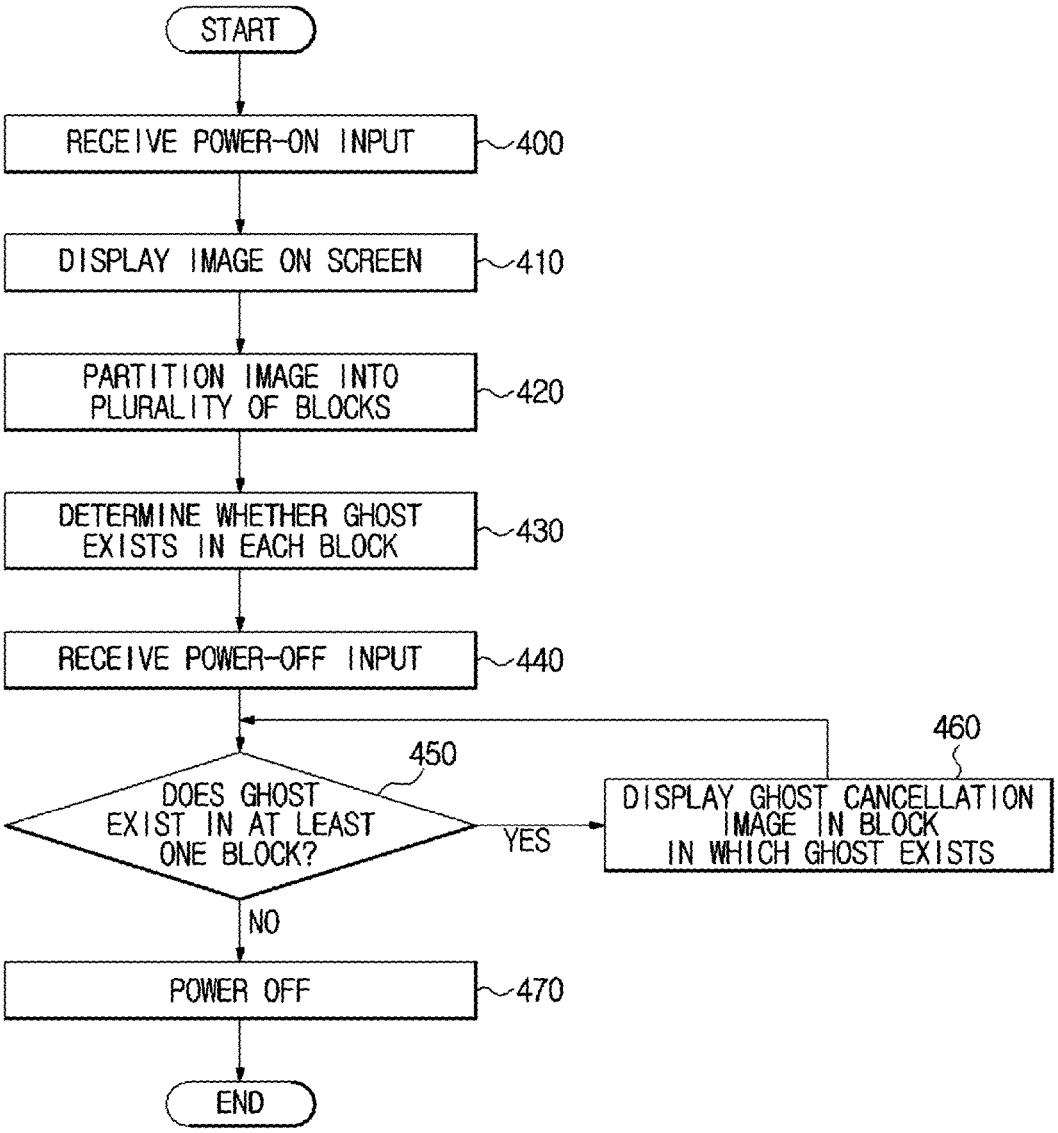
FIG. 8 is a flowchart illustrating a control method of a display device, according to an exemplary embodiment of the present disclosure.

FIG. 8 is a flowchart illustrating a control method of a display device, according to an exemplary embodiment of the present disclosure.

First, referring to FIGS. 2 and 8, a power-on input may be received through the input unit 300 (operation 400). Then, power may be supplied to the display device 100 according to the power-on input so that the display device 100 is ready to operate according to a user command.

Then, output signals may be received to display an image on the screen 110 (operation 410). The screen 110 may include a display panel, and the display panel may be a LCD panel, an ELD panel, a FED panel, a PDP, a TFT-LCD panel, or an OLED panel.

The image that is displayed on the screen 110 may be a still image or a moving image. If the image that is displayed on the screen 110 is a moving image, image frames may be sequentially displayed.

While the image is displayed on the screen 110, the image may be partitioned into a plurality of blocks (operation 420). Partitioning an image into a plurality of blocks is aimed at performing computations for each unit of a block, instead of displaying the partitioned blocks on the screen 110.

After the image is partitioned into the plurality of blocks, a determination is made for whether or not ghost exists in each block (operation 430). By determining whether or not ghost exists in each block, instead of determining whether ghost exists in the entire screen 110, a location of ghost can be accurately determined so that a ghost cancellation method corresponding to the ghost can be applied to the ghost.

A method of determining whether ghost exists will be described with reference to FIGS. 9 and 10.

Determining whether ghost exists in a unit of a block may be repeatedly performed at regular time intervals.

While the image is displayed on the screen 110 and it is determined whether or not ghost exists in each block, a power-off input may be received through the input unit 300 (operation 440). The power-off input may be input by a user in order to power off the display device 100. Before the display device 100 powers off, ghost cancellation may be automatically performed.

By cancelling ghost automatically before power-off without receiving a user input for performing ghost cancellation, user inconvenience may be removed.

When a power-off input is received, it may be determined whether ghost exists in at least one block of the plurality of blocks (operation 450). If it is determined that ghost exists in at least one block, the ghost of the corresponding block may be cancelled. In order to cancel the ghost, a ghost cancellation image may be displayed in the corresponding block (operation 460).

In order to efficiently cancel the ghost, a ghost cancellation image corresponding to a level or shape of the ghost may be displayed. This will be described with reference to FIG. 11.

If it is determined that no ghost exists in any of the plurality of blocks before ghost cancellation or after ghost cancellation, the display device 100 may be powered off according to the power-off input (operation 470).

Hereinafter, a method of determining whether or not ghost exists will be described in more detail with reference to FIGS. 9 and 10.

Figure 9:
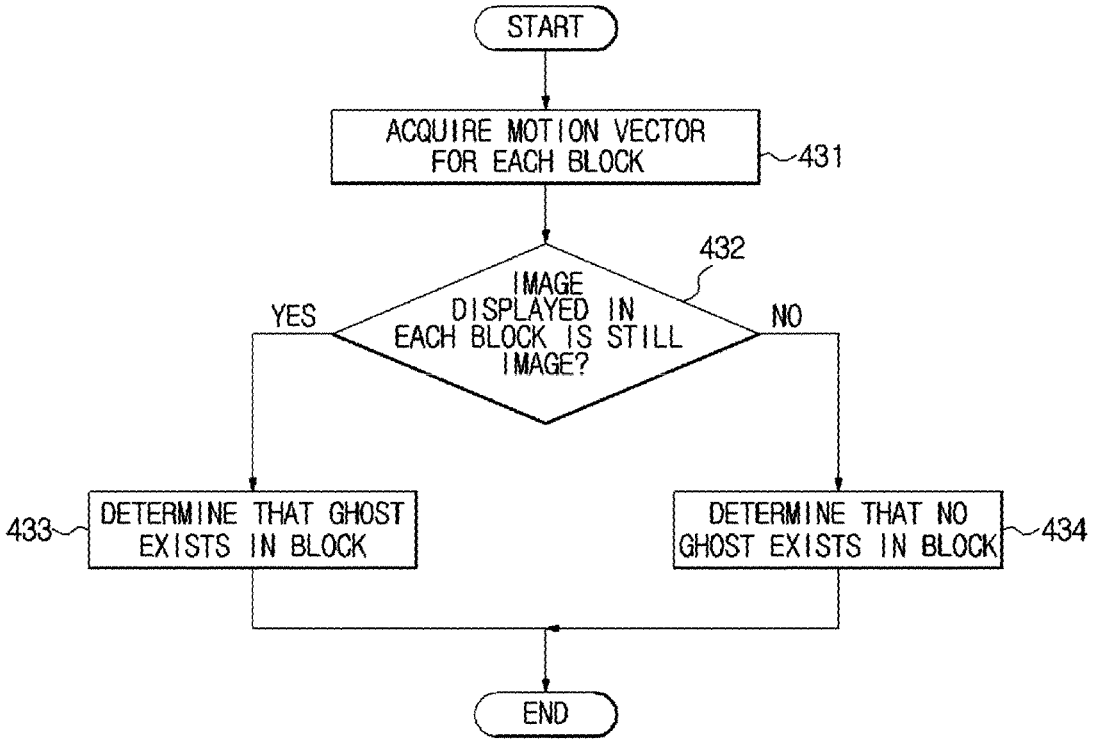
FIG. 9 is a flowchart illustrating a method of determining whether or not ghost exists, according to an exemplary embodiment of the present disclosure.

FIG. 9 is a flowchart illustrating a method of determining whether or not ghost exists, according to an exemplary embodiment of the present disclosure.

First, a motion vector for each of a plurality of blocks may be acquired (operation 431). The motion vector may be acquired from two sequential image frames.

The acquired motion vectors may be accumulated. More specifically, an operation of acquiring a motion vector from two sequential image frames for each block may be repeatedly performed at regular time intervals to acquire a plurality of motion vectors for the block, and the acquired motion vectors may be accumulated in the block.

Thereafter, it is determined whether an image displayed in each block is a still image based on the motion vectors acquired for the block (operation 432). If the motion vectors of the block are zero, the image displayed in the block may be determined to be a still image.

If it is determined that a still image is displayed in the block, a part of a plurality of pixels included in the block may deteriorate. Accordingly, it may be determined that ghost exists in the block in which the still image has been displayed (operation 433). Further, if it is determined that no still image is displayed in the block, the plurality of pixels included in the block do not deteriorate. Accordingly, it may be determined that no ghost exists in the block (operation 434).

If it is determined that the ghost exists in the block, a level or shape of the ghost may be determined for ghost cancellation.

Figure 10:
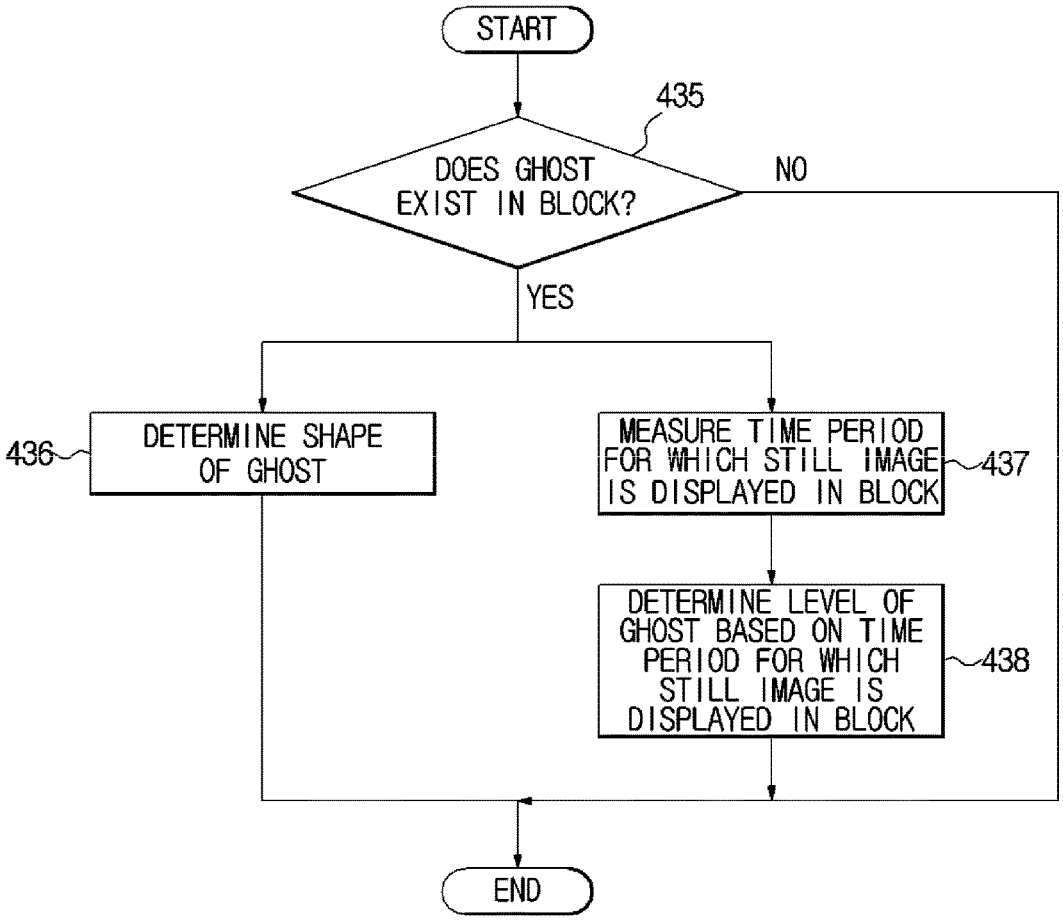
FIG. 10 is a flowchart illustrating a method of determining a level or shape of ghost, according to an exemplary embodiment of the present disclosure.

FIG. 10 is a method of determining a level or shape of ghost, according to an exemplary embodiment of the present disclosure.

First, it is determined whether or not ghost exists in each block (operation 435). Whether or not ghost exists in each block may be determined by the method described above with reference to FIG. 9.

If a block in which ghost exists is found, a shape or level of the ghost may be determined. Then, efficient ghost cancellation may be performed based on the determined shape or level of the ghost.

If a block in which ghost exists is found, a shape of the ghost may be determined (operation 436). The shape of the ghost may be determined based on the locations of deteriorated pixels.

The shape of the ghost may be compared to predetermined geometric shapes so that a shape most similar to the shape of the ghost can be selected from among the predetermined geometric shapes. Predetermined geometric shapes may be line shapes extending in predetermined directions. A ghost cancellation image may be determined according to the direction of a line shape corresponding to the shape of the ghost.

When a block in which ghost exists is found, a level of the ghost in addition to the shape of the ghost may be determined. The level of the ghost may be a degree of deterioration of pixels included in the block.

In order to determine a level of the ghost, a time period for which a still image is displayed in the block may be measured (operation 437). This is because a degree of deterioration of pixels may be proportional to a time period for which a still image is displayed.

Accordingly, a level of the ghost may be determined based on a time period for which a still image is displayed in the block (operation 438). The level of the ghost may be digitized according to the time period for which the still image is displayed in the block. A time period for which a ghost cancellation image is displayed may be decided according to the digitized level of the ghost.

If a shape and level of the ghost are determined according to the method described above with reference to FIG. 10, ghost cancellation may be performed based on the shape and level of the ghost.

Figure 11:
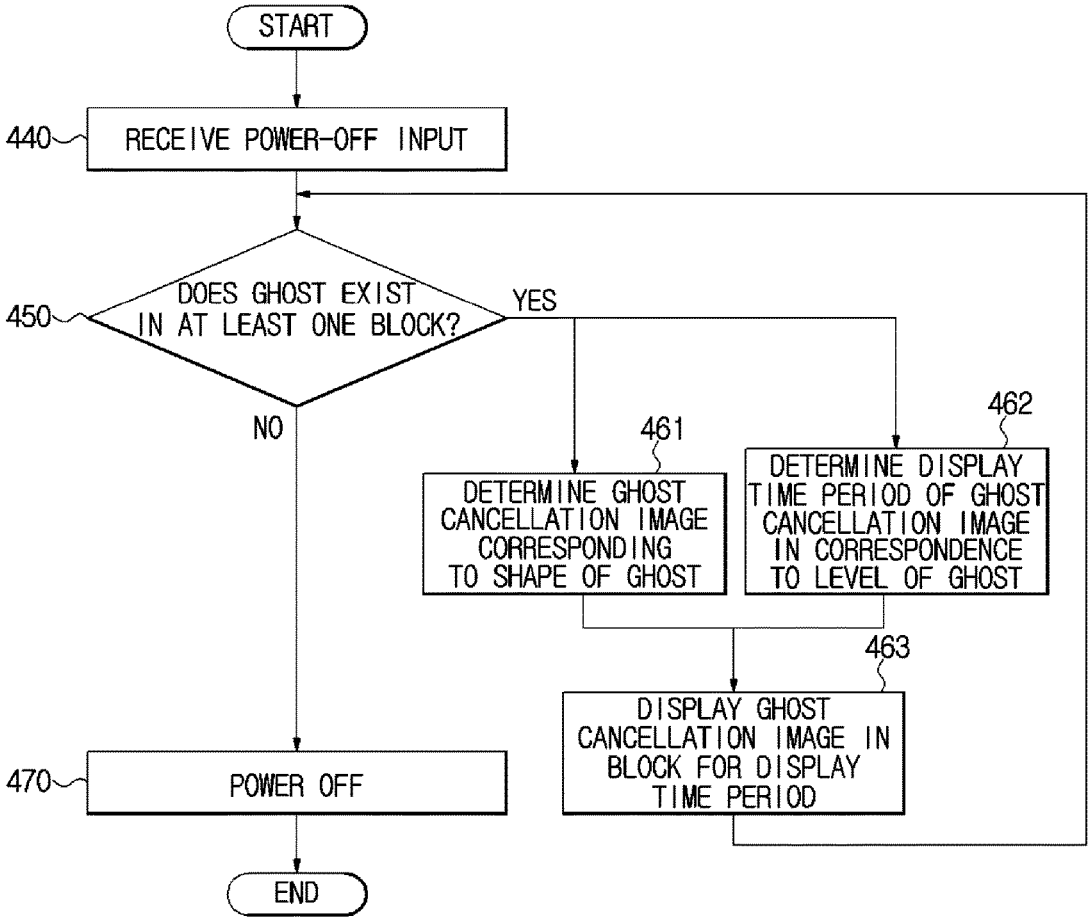
FIG. 11 is a flowchart illustrating a method of canceling ghost according to a shape and level of the ghost, according to an exemplary embodiment of the present disclosure.

FIG. 11 is a flowchart illustrating a method of canceling ghost according to a shape and level of the ghost, according to an exemplary embodiment of the present disclosure.

If a user applies a power-off input, ghost cancellation may be performed. That is, ghost cancellation may be automatically performed according to a power-off input even though a user applies no user input to perform ghost cancellation.

If a power-off input is applied (operation 440), it may be determined whether ghost exists in at least one block of a plurality of blocks (operation 450). If it is determined that no ghost exists in any of the plurality of blocks, the display device may be powered off according to the power-off input (operation 470).

If it is determined that the ghost exists in at least block of the plurality of blocks, ghost cancellation may be performed on the block in which the ghost exists. A shape and level of the ghost may be determined according to the method described above with reference to FIG. 10. Further, ghost cancellation may be performed according to the determined shape and level of the ghost.

More specifically, a ghost cancellation image corresponding to the determined shape of the ghost may be determined (operation 461). If the shape of the ghost is a line shape extending in a predetermined direction, a ghost cancellation image corresponding to the predetermined direction may be determined.

Also, a display time period of the ghost cancellation image may be determined in correspondence to the determined level of the ghost (operation 462). If the level of the ghost is digitized, a display time period of the ghost cancellation image may be determined in correspondence to the digitized value.

If the ghost cancellation image and the display time period are determined, ghost cancellation may be performed on the corresponding block. More specifically, the ghost cancellation image may be displayed in the block in which the ghost exists for the display time period, thereby cancelling the ghost (operation 463).

If ghost cancellation images are displayed in all blocks in which ghost exist to cancel the ghost of the blocks, the display device may be powered off according to the power-off input (operation 470).

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A display device comprising:

a screen configured to display an image;

a calculator configured to partition the screen into a plurality of blocks and determine whether or not ghost exists in at least one block of the blocks; and a controller configured to cancel existing ghost in the at least one block in response to the calculator determining that the ghost exists in the at least one block of the blocks, wherein the calculator is configured to determine a shape of the ghost existing in the at least one block in response to the calculator determining that the ghost exists in the at least one block.

2. The display device of claim 1, wherein the calculator is further configured to determine whether a sub image displayed in the at least one block of the blocks is a still image and determine whether or not the ghost exists in the at least one block based on each of the determined sub image displayed in the at least one block.

3. The display device of claim 1, wherein the calculator is further configured to calculate a motion vector of the at least one block to determine whether or not the ghost exists in the at least one block.

4. The display device of claim 1, wherein the controller is further configured to display a ghost cancellation image in the at least one block to cancel the ghost.

5. The display device of claim 1, wherein the controller is further configured to display a ghost cancellation image which corresponds to the shape of the ghost in the at least one block such that the ghost is cancelled.

6. The display device of claim 1, wherein in response to the calculator determining that no ghost exists in any of the blocks, the controller is further configured to power off the display device according to a predetermined input.

7. The display device of claim 1, wherein the calculator is configured to determine a level of the ghost in response to the calculator determining that the ghost exists in the at least one block, wherein the level of the ghost is determined according to a time period in which a still image is displayed in the at least one block.

8. The display device of claim 7, wherein the controller is further configured to display a ghost cancellation image in the at least one block for a time period which corresponds to the level of the ghost, such that the ghost is cancelled.

9. A control method of a display device which includes a screen configured to display an image, the control method comprising:

partitioning the image into a plurality of blocks;

determining whether or not ghost exists in at least one block of the blocks; and cancelling existing ghost in the at least one block in response to determining that the ghost exists in the at least one block of the blocks, wherein the determining whether or not ghost exists in the at least one block further comprises determining a shape of the ghost existing in the at least one block in response to determining that the ghost exists in the at least one block.

10. The control method of claim 9, wherein the determining whether or not ghost exists in the at least one block comprises determining whether a sub image displayed in the at least one block of the blocks is a still image.

11. The control method of claim 9, wherein the determining whether or not ghost exists in the at least one block comprises calculating a motion vector of the at least one block of the blocks.

12. The control method of claim 9, wherein the cancelling the existing ghost in the at least one block comprises displaying a ghost cancellation image in the at least one block to cancel the ghost.

13. The control method of claim 9, wherein the cancelling the existing ghost in the at least one block comprises displaying a ghost cancellation image which corresponds to the shape of the ghost in the at least one block such that the ghost is cancelled.

14. The control method of claim 9, further comprising turning off power according to a predetermined input in response to determining that no ghost exists in any of the blocks.

15. The control method of claim 9, wherein the determining whether or not ghost exists in the at least one block further comprises determining a level of the ghost in response to determining that the ghost exists in the at least one block, wherein the level of the ghost is determined according to a time period in which a still image is displayed in the at least one block.

16. The control method of claim 15, wherein the cancelling the ghost existing in the at least one block comprises displaying a ghost cancellation image in the at least one block for a time period which corresponds to the level of the ghost such that the ghost is cancelled.

17. A method of determining whether ghost exists in an image, the method comprising:

partitioning an image into a plurality of blocks such that each block of the blocks comprises at least one pixel;

calculating a motion vector which comprises a direction and a magnitude of each block of the blocks over a predetermined time period; and determining ghost exists in each block of the blocks in response to the motion vector comprising no direction and no magnitude over the predetermined time period, wherein the determining ghost exists in each block of the blocks further comprises determining a shape of the ghost existing in each block of the blocks.

18. The method of claim 17, wherein the predetermined time period in which the motion vector is calculated comprises two sequential image frames.

19. The method of claim 17, wherein the motion vector is repeatedly calculated over the predetermined time period at specified time intervals of an image display period.

* * * * *